US005089224A

United States Patent [19]

Bletton et al.

[11] Patent Number: 5,089,224

[45] Date of Patent: Feb. 18, 1992

[54] RESULPHURIZED AUSTENITIC STAINLESS STEEL WITH IMPROVED MACHINABILITY

[75] Inventors: Olivier Bletton, Ugine; Roger Duet, Albertville; Marc Henry; Jean-Yves Cogne, both of Ugine, all of France

[73] Assignee: Ugine Savoie, Ugine, France

[21] Appl. No.: 537,465

[22] Filed: Jun. 13, 1990

[30] Foreign Application Priority Data

Jun. 16, 1989 [FR] France ..... 89 08060

[51] Int. Cl.[5] ..... C22C 38/44; C22C 38/60

[52] U.S. Cl. ..... 420/41; 420/42; 420/57; 420/46

[58] Field of Search ..... 420/41, 42, 57, 46

[56] References Cited

FOREIGN PATENT DOCUMENTS 56-90959 7/1981 Japan ..... 420/42

*Primary Examiner*—Deborah Yee

*Attorney, Agent, or Firm*—Cushman, Darby & Cushman

[57] ABSTRACT

Resulphurized austenitic stainless steel with improved machinability, characterized in that its weight composition is the following:

carbon lower than or equal to 0.15%
silicon lower than or equal to 2%
manganese lower than or equal to 2%
molybdenum lower than or equal to 3%
nickel between 7 and 12%
chromium between 15 and 25%
sulphur between 0.10 and 0.40%
calcium higher than or equal to $30\times10^{-4}$%
oxygen higher than or equal to $70\times10^{-4}$%
the ratio of the calcium content and of the oxygen content Ca/O being between 0.2 and 0.6.

8 Claims, 4 Drawing Sheets $SiO_2$
$Al_2O_3$
CaO
WEIGHT %
Pseudo-wollastonite
Anorthite
$CaO-Al_2O_3-2SiO_2$
Gehlenite
$2CaO-Al_2O_3-SiO_2$
$CaO-SiO_2$
10
20
30
40
50
60
70
80
90

RESULPHURIZED AUSTENITIC STAINLESS STEEL WITH IMPROVED MACHINABILITY

The present invention relates to a resulphurized austenitic stainless steel with improved machinability.

Such an austenitic steel is known from JP-A-160,785. This patent deals with a steel which is machinable and deformable when cold and which has, in weight composition, especially, a sulphur content lower than 0.030%, calcium and oxygen contents included in the ranges 10–300 ppm and 30–300 ppm respectively, from 0.8 to 5% of copper and from 0.01 to 0.25% of lead.

Oxygen and calcium are introduced into this austenitic stainless steel, and this allows the hard inclusions to be converted into inclusions based on calcium oxide. The improvement in the machinability is generated by the introduction of a variable quantity of lead into the composition.

It is well known that austenitic stainless steels are difficult to machine, to a large extent owing to their low heat conductivity, resulting in a poor flow of the heat produced at the tip of a cutting tool and a rapid deterioration of the tool, and to their high cold drawability giving rise locally to regions of high hardness.

A means of improving the machinability is the introduction of the element lead, especially in a proportion of 0.01 to 0.25%. This element has the disadvantages of being difficult to dissolve homogeneously in the molten bath and, because of its high density, of tending to accumulate in the bottom of metallurgical vessels. Moreover, it forms phases of low melting point, impairing the hot deformability.

In FR-A-2,542,761, which describes a process for the manufacture of steel of high machinability, it is stated that another cause of the difficulty in machining stainless steels is the fact that they contain inclusions of hard oxides like, for example, alumina or chromite, which damage the cutting tools.

A means of reducing the harmfulness of the hard oxide inclusions is to introduce into the steel one or more alkaline-earth metal compounds, in order to replace a good proportion of the hard inclusions with inclusions of oxides based, for example, on calcium. It is stated, on the one hand, that a certain quantity of sulphur combined with the hard inclusions reduces their harmfulness, the sulphur content being generally lower than $0.5\times10^{-4}$% and, on the other hand, that another means of reducing the harmfulness of the inclusions is to reduce their quantity by virtue of a good deoxidation and a good separation of the molten bath when the steel is produced.

In the documents referred to above the improvement in the machinability of the steel is produced:

- by introduction of lead as a lubricant,
- by introduction of oxygen or of calcium to reduce the hard inclusions to inclusions based on alkaline-earth metal compounds,
- by reducing the number of hard inclusions by deoxidation of the molten bath during the production.

The subject of the present invention is a resulphurized austenitic steel with improved machinability, containing, on the one hand, sulphur for creating a sulphide of manganese and chromium which has lubricating properties and, on the other hand, a determined proportion of oxygen and of calcium, which is introduced in the form of lime silicoaluminate, in order to create, in numbers, specific inclusions improving the machinability.

The austenitic stainless steel is characterized by the following composition, expressed in percentages by weight:

- carbon lower than or equal to 0.15%
- silicon lower than or equal to 2%
- manganese lower than or equal to 2%
- molybdenum lower than or equal to 3%
- nickel between 7 and 12%
- chromium between 15 and 25%
- sulphur between 0.10 and 0.40%
- calcium higher than or equal to $30\times10^{-4}$%
- oxygen higher than or equal to $70\times10^{-4}$%
- the ratio of the calcium content and of the oxygen content Ca/O being between 0.2 and 0.6.

The calcium is introduced into the molten bath during the production, by adding silicocalcium under the control of the oxygen contents.

In a preferred composition of the invention the austenitic steel includes sulphur in a proportion of between 0.15 and 0.35%. With the manganese and in a smaller proportion with the chromium, the sulphur forms a manganese chromium sulphide (Mn,Cr)S which generates, in the form of inclusions, a hot lubrication of the cutting tool when the steel is machined.

In another form of the invention, the value of the ratio of the contents of the elements calcium and oxygen is between 0.3 and 0.5.

The range of values of the ratio Ca/O is determined by measurements of machinability of the various steels which have the basic composition of the steel according to the invention and in which the contents of calcium and oxygen are varied.

In particular, the manganese chromium sulphide inclusions are coated with a lime silicoaluminate phase of the anorthite and/or pseudowollastonite type to form associated inclusions. The creation of this type of inclusion is made possible by virtue of the introduction of calcium compounds into the liquid bath under the control of determined oxygen contents.

In addition, the associated inclusions have a shape factor of between 3 and 6. The shape factor is determined by the ratio of the length over the width of the inclusion, the value of the shape factor being a criterion of measurement of the quality of machinability of the steel.

The tests described below and the attached figures will make the invention easier to understand.

The present invention relates to a resulphurized austenitic stainless steel alloy whose machinability is improved by the creation of associated, lime silicoaluminate/manganese chromium sulphide inclusions.

The alloy comprises, by weight:

carbon lower than or equal to 0.15%
silicon lower than or equal to 2%
manganese lower than or equal to 2%
molybdenum lower than or equal to 3%
nickel between 7 and 12%
chromium between 15 and 25%
sulphur between 0.10 and 0.40%
oxygen higher than or equal to 70 ppm
calcium higher than or equal to 30 ppm.

The beneficial effect of sulphur on the machinability is well known. In steel, sulphur gives rise to manganese sulphide inclusions which also contain chromium.

The addition of sulphur or else, for example, of selenium, makes it possible to improve the machinability of austenitic stainless steels, but at the expense of other properties, like, for example, a decrease in the corrosion resistance and in the deformability when heated and when cold.

Despite the unfavorable effect of a reduction in the corrosion resistance produced by the sulphur, the tests on the machinability of austenitic steels have been in the direction of the introduction of lime silicoaluminate oxides into a resulphurized steel. These oxides do not impair the corrosion resistance.

The lime silicoaluminate oxides are created during the production of the steel by virtue of the introduction of calcium, preferably in the form of a silicocalcium-cored wire, into the molten bath under the control of the oxygen contents.

According to the invention, the oxides are predominantly bound up with the sulphides and form, with the sulphide inclusions, associated inclusions, the sulphide being situated inside the oxygen inclusions. These sulphides are manganese sulphides which nevertheless also contain chromium.

Figure 1:
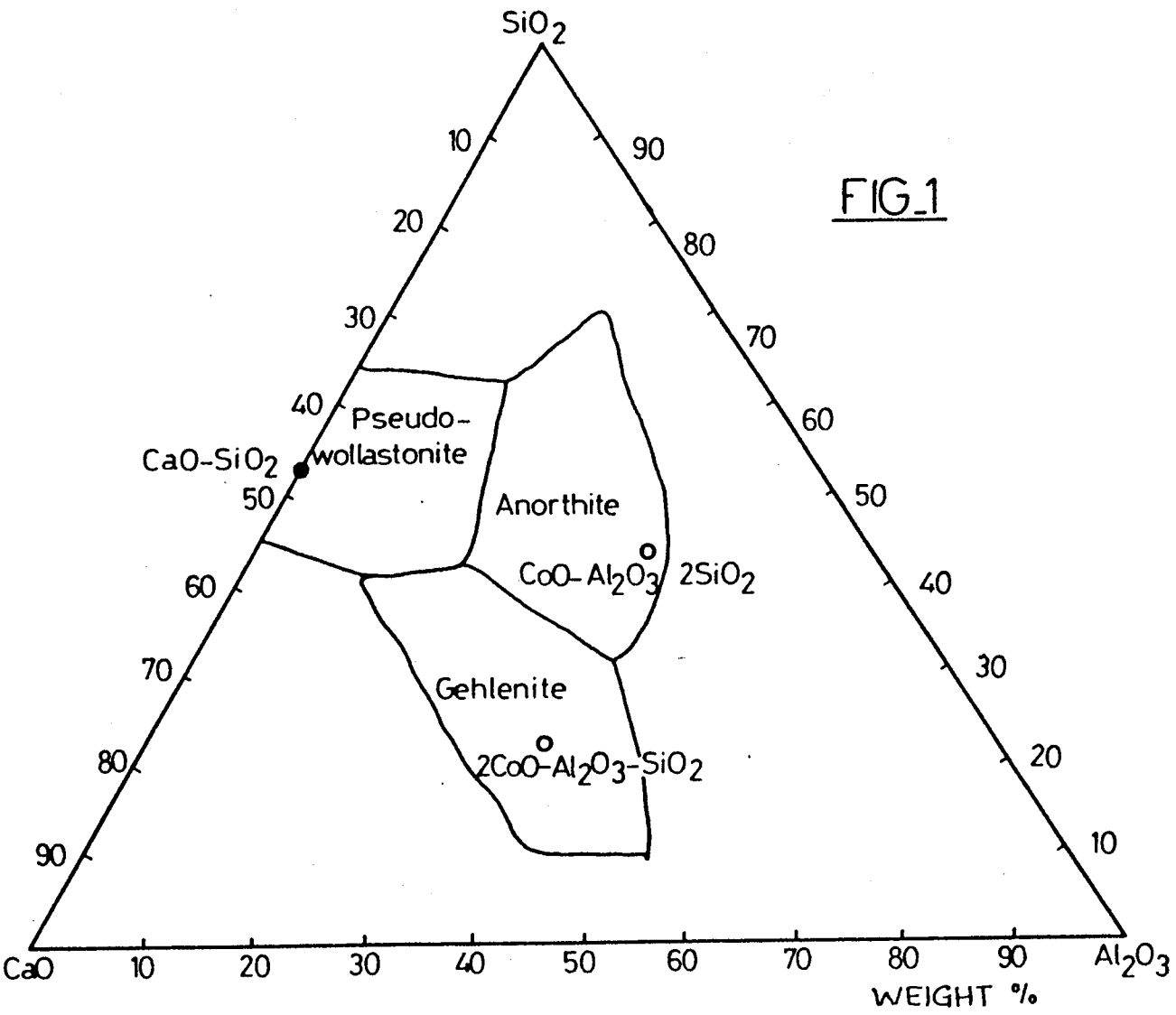
FIG. 1 shows the $CaO—Al_2O_3—SiO_2$ ternary composition diagram locating the weight composition of anorthite, of pseudowollastonite and of gehlenite

In their chemical composition, the lime silicoaluminate oxides are preferably anorthite or pseudowollastonite (the chemical composition of which is shown on the ternary diagram of FIG. 1), most of the said oxides being anorthite. These oxides may additionally contain a little MnO.

The lime silicoaluminate oxides formed around the sulphides are malleable oxides of low melting point, which can be easily deformed during rolling. Because of the high cutting temperatures, when the steel is machined these inclusions act as a lubricant at the interface between the steel to be machined and the cutting tool, thus resulting in a reduced wear on the cutting tools and in a better surface appearance of the machined articles.

Research which has been carried out has made it possible to arrive at the definition of a composition of steel of high machinability starting from a base whose composition has been given above and which has essentially:

a sulphur content of 0.15 to 0.35%,
a calcium content higher than or equal to 30 ppm in the finished product,
an oxygen content higher than or equal to 70 ppm in the finished product,
a ratio of the Ca/O element contents of between 0.3 and 0.5.

This results in:

the presence of lime silicoaluminate oxide inclusions, preferably of anorthite (predominant) or of pseudowollastonite (subsidiary), generally coating, manganese chromium sulphides.

Figure 2:
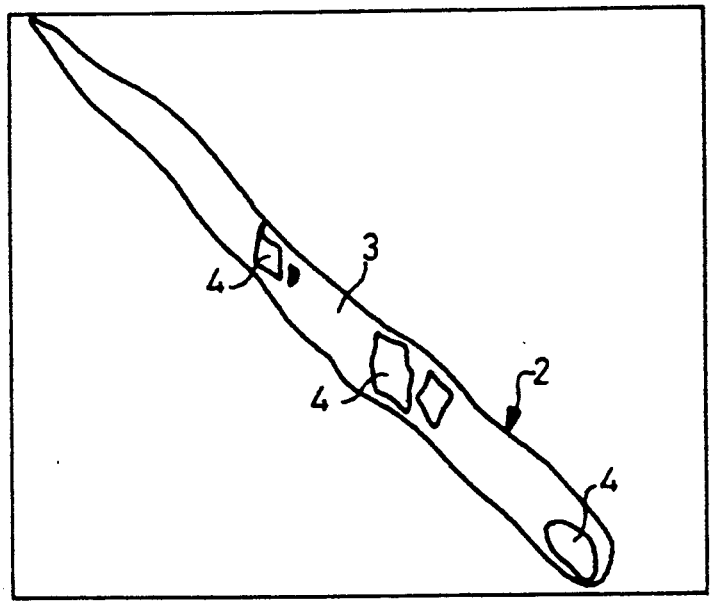
FIG. 2 shows a sectioned image of an associated inclusion.

FIG. 2 is a sectioned image of a steel according to the invention containing a lens-shaped associated inclusion 2 consisting of lime silicoaluminate 3 coating, inclusions of manganese chromium sulphide 4.

Clearly, there is no formation of calcium sulphide, a sulphide known to be harmful to the machinability of the steels and to corrosion resistance.

The following tests illustrate the machinability qualities of the steel according to the invention in a comparative manner.

Turning tests with a carbide tool (of ISO reference P20) were carried out. Various cutting rates are fixed for a cut depth of 1.5 mm and a feed of 0.25 mm/turn. At each cutting speed the tool is disassembled every 4 min to measure the wear in relief. Thus, for a number of speeds V1, V2, V3 etc., a curve is plotted, giving the relief wear of the tool as a function of the machining time. The cutting speed producing a relief wear of 0.3 mm in 30 mn can thus be determined for each production, and can be taken as reference under the VB30/0.3 criterion.

Table I below gives some results obtained on steels whose basic composition is: C: 0.05%, Si: 0.5%, Mn: 1.8%, Ni: 8.6%, Cr: 17%, Mo: 0.2%, S: 0.3%, but whose calcium and oxygen contents vary. In addition, in the case of each production, the average surface area and the average shape factor (length/width) of the sulphide inclusions and of the associated oxide/sulphide inclusions are given.

TABLE I

| STEEL No. | Ca (ppm) | O (ppm) | Ca/O | VB 30/0.3 (m/mn) | ASSOCIATED INCLUSIONS SURFACE AREA $(mm)^2$ | ASSOCIATED INCLUSIONS SHAPE FACTOR | SULPHIDE SURFACE AREA $(mm)^2$ | SULPHIDES SHAPE FACTOR |
|---|---|---|---|---|---|---|---|---|
| 1 | 5 | 94 | 0.05 | 245 | 2.4 | 1.8 | 39.3 | 3.1 |
| 2 | 5 | 70 | 0.07 | 250 | 2.1 | 2.1 | 31.1 | 3.2 |
| 3 | 45 | 120 | 0.38 | 300 | 24.9 | 4.5 | 31.4 | 3.1 |
| 4 | 43 | 105 | 0.41 | 295 | 41.9 | 5 | 21.7 | 2.8 |
| 5 | 40 | 96 | 0.42 | 303 | 39.8 | 5.4 | 31.4 | 3.1 |
| 6 | 47 | 102 | 0.40 | 300 | 39.2 | 4.8 | 27.4 | 3.4 |
| 7 | 35 | 73 | 0.48 | 308 | 45.5 | 5.6 | 35.3 | 3.7 |

Steels No. 1 and No. 2 constitute references and contain no lime silicoaluminate.

The associated inclusions are very few in number, very small and slightly deformed.

Steels No. 3 to 7 correspond to a composition according to the invention. The values of VB 30/0.3 are approximately 20% higher. The average surface area and the average shape factor of the sulphide inclusions of steels No. 1 and No. 2, on the one hand, and of steels No. 3 to No. 7 do not differ significantly.

In contrast, the associated inclusions of the steels according to the invention (No. 3 to 7) have a much greater surface area and are much more deformed and therefore much more deformable.

These associated lime silicoaluminate inclusions coating the manganese chromium sulphide inclusions are thus at the source of the large increase in the value of the machinability criterion VB 30/0.3.

Similarly, turning tests with a TiN-coated carbide tool were carried out. These tools are increasingly being employed by machinists. The relief wear of the tool was measured as a function of time for a feed of 0.25 mm/turn, a 1.5 mm cut and a speed of 340 m/min. Table II below gives some values obtained on steels No. 1, 4, 5 and 6 of the preceding table.

TABLE II

| STEELCa No. | O (ppm) | Ca/O (ppm) | | Time for 0.15 mm wear (min) | Wear after 30 min of cutting (mm) |
|---|---|---|---|---|---|
| 1 | 5 | 94 | 0.05 | 5 | 0.27 |
| 4 | 43 | 105 | 0.41 | 22 | 0.16 |
| 5 | 40 | 96 | 0.42 | 24 | 0.16 |
| 6 | 47 | 102 | 0.46 | 24 | 0.17 |

In these tests the criteria chosen for comparing the steels are, on the one hand, the time resulting in a relief wear of 0.15 mm undo the cutting conditions given above and, on the other hand, the measurement of the relief wear after 30 min of cutting.

Thus, compared with the reference steel No. 1 which does not correspond to a composition according to the invention, the tests performed on steels No. 4, 5 and 6 show that the cutting time before a wear of 0.15 mm is multiplied by a factor of 4 and that the measured wear on the tool after 30 min of cutting is reduced by approximately 60%.

This improvement is linked with the associated inclusions described and introduced into the steel according to the invention.

Figure 3:
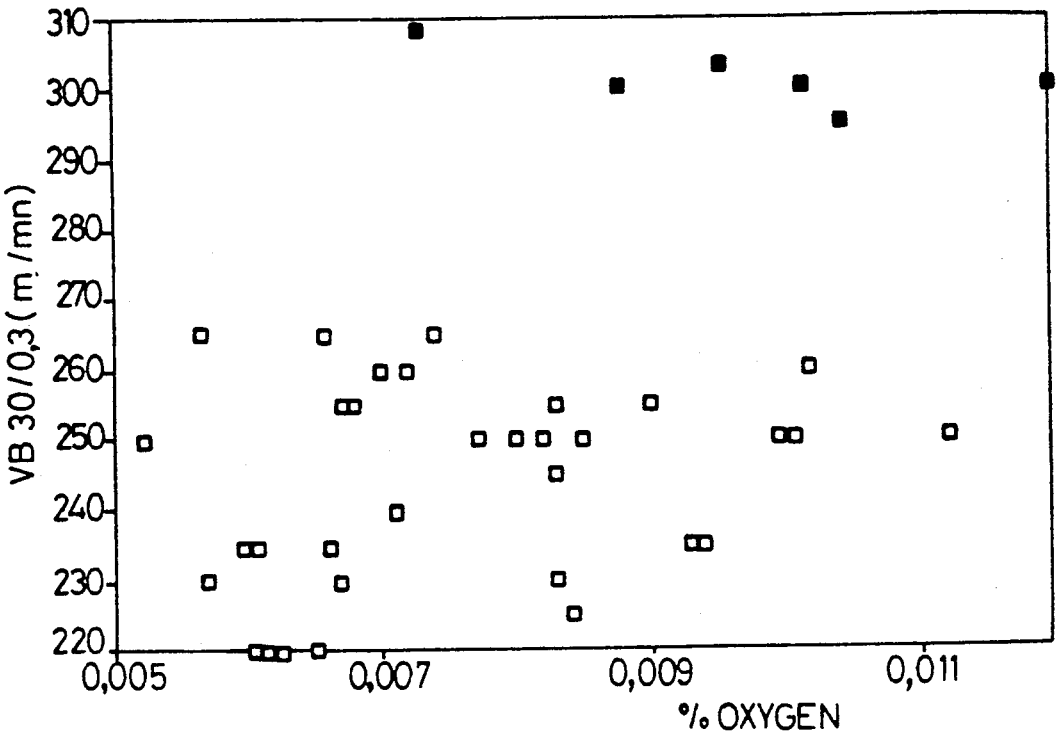
FIG. 3 is a diagram showing the values of the machinability criterion VB30/0.3 as a function of the change in oxygen concentration.

FIG. 3 shows a diagram which gives the variations in the machinability criterion VB 30/0.3 as a function of the oxygen concentration in a series of measurements corresponding, on the one hand, to the production of the steels according to the invention and, on the other hand, to the production of the calcium-free steel.

Figure 4:
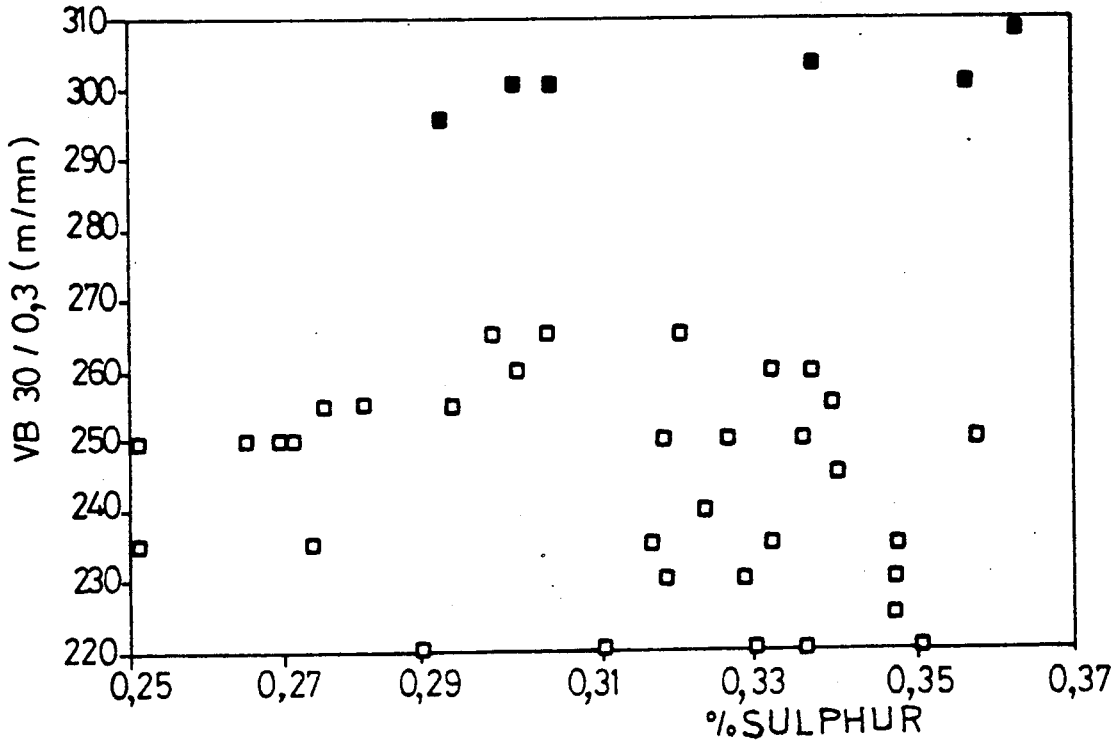
FIG. 4 is a diagram showing the values of the machinability criterion VB30/0.3 as a function of the change in sulphur concentration.

FIG. 4 shows a diagram which gives the variations in the machinability criterion VB 30/0.3 as a function of the sulphur concentration in a series of measurements corresponding, on the one hand, to the production according to the invention and, on the other hand, to the production of the calcium-free steel.

FIGS. 3 and 4 show firstly that the progression of resulphurized austenitic stainless steel grades towards high oxygen contents or high sulphur contents does not enable the machinability to be improved significantly (VB 30/0.3 criterion). In contrast, in the diagrams of FIGS. 3 and 4, the steels according to the invention constitute a population in a class of its own, with high machinability criteria.

By way of comparison, the same machinability tests were carried out using the machinability criterion VB 30/0.3 on austenitic steels whose basic composition is as follows:

C: 0.06%, Si: 0.45%, Mn: 0.6%, Ni: 8.6%, Cr: 18%, Mo: 0.2%, S: 0.02%.

These steels contain very little or no sulphur, compared with the steel according to the invention.

The tests concerned the variation in calcium and oxygen, using the same operating procedure for introducing lime silicoaluminate as in the production of the steels according to the invention.

Table III below gives the values of VB 30/0.3 for a number of steels, as a function of the calcium and oxygen content and of the value of the ratio of the element concentrations.

TABLE III

| STEEL No. | Ca (ppm) | O (ppm) | Ca/O | VB 30/0.3 (m/mn) |
|---|---|---|---|---|
| 8 | 2 | 57 | 0.04 | 168 |
| 9 | 6 | 123 | 0.05 | 160 |
| 10 | 32 | 79 | 0.4 | 200 |
| 11 | 43 | 118 | 0.36 | 200 |
| 12 | 26 | 47 | 0.55 | 155 |
| 13 | 17 | 117 | 0.15 | 172 |
| 14 | 32 | 129 | 0.25 | 180 |

Steels No. 8 and No. 9 contain little or no calcium and are the reference steels for these measurements. The oxide inclusions are of the polyphase silicate and chromite type.

The progression towards high oxygen contents by themselves does not produce an improvement in machinability (comparison of the values of VB 30/0.3 between the steels No. 8 and 9).

Figure 5:
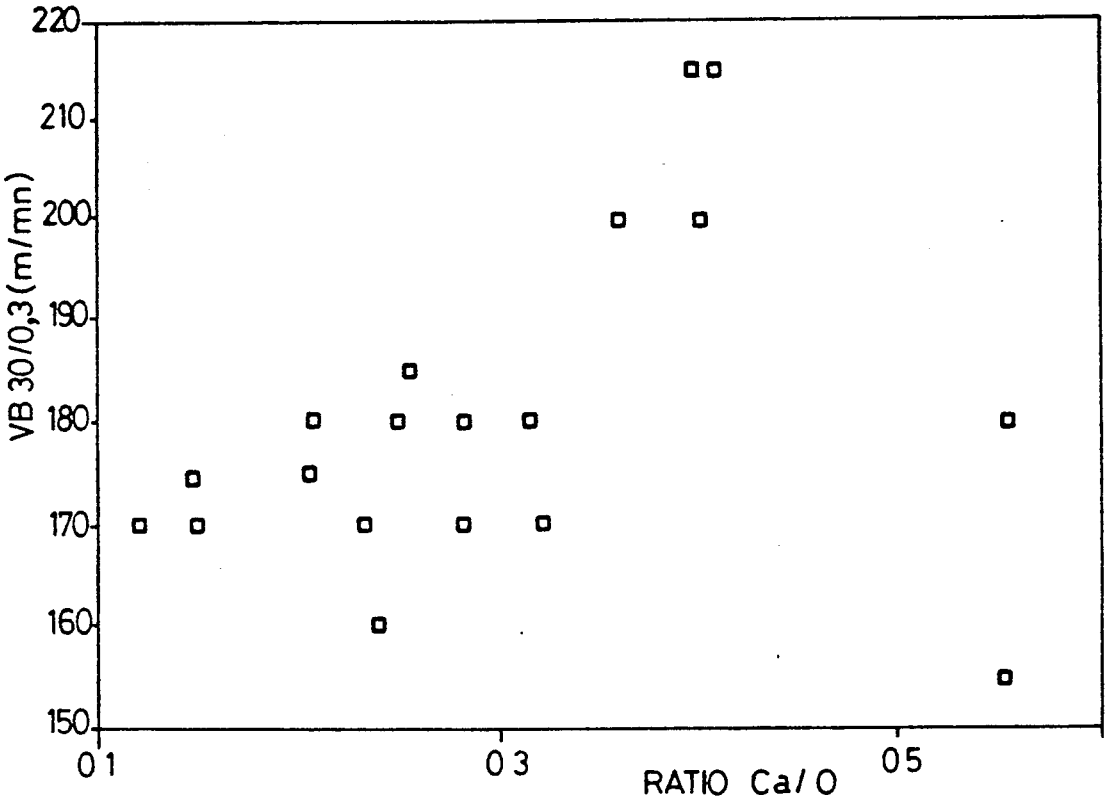
FIG. 5 shows, in an example of steel given by way of comparison (steel according to the invention, without sulphur), a diagram showing the values VB30/0.3 as a function of the ratio of the Ca/O contents.

Steels No. 10 and No. 11, which have:

a calcium content higher than 30 ppm in the finished product, an oxygen content higher than 70 ppm in the finished product, a ratio of the Ca/O element contents of between 0.30 and 0.50, have only oxide inclusions of anorthite type. On machining, an increase in the values of the machinability criterion VB 30/0.3 is noted, as shown by way of example in FIG. 5.

Steel No. 12 has low calcium and oxygen contents and a very high Ca/O ratio. The machinability remains mediocre. The chemically analysed inclusions are of gehlenite type (FIG. 1).

Steel No. 13 has an oxygen content corresponding to that of the composition of the steel according to the invention without sulphur, but a calcium content and a Ca/O ratio which is lower. The machinability is not improved significantly.

Steel No. 14 has contents corresponding to those of the composition of the steel according to the invention without sulphur, but a Ca/O ratio below 0.30. The improvement in machinability is appreciable but remains well below that of steels No. 10 and No. 11.

Comparison of the VB 30/0.3 values of Tables I and III shows the magnitude of the effect of the anorthite inclusions by themselves and of the effect of the inclusions present in the resulphurized steel according to the invention.

The subject of the present invention is a resulphurized austenitic stainless steel whose machinability is improved by virtue of the creation of oxide associated inclusions of lime silicoaluminate/(Mn,Cr)S sulphide type.

The characteristics which make it possible to obtain an improved machinability are:

a sulphur content of between 0.10 and 0.40%, preferably between 0.15 and 0.35% a calcium content higher than or equal to 30 ppm,
an oxygen content higher than or equal to 70 ppm,
a ratio of the calcium content and of the oxygen content Ca/O of between 0.2 and 0.6 and preferably between 0.3 and 0.5.

This results in the presence of associated and deformed inclusions of oxides coating sulphide inclusions. The oxides are lime silicoaluminates, preferably of anorthite and pseudowollastonite type, whose chemical compositions are determined in the $CaO—SiO_2—Al_2O_3$ ternary diagram of FIG. 1. These associated inclusions have a large surface area and shape factor (length/width). The high deformability of the inclusions and their lubricating ing effect at the cutting tool/-chip interface permit an improvement in the machinability.

We claim:

1. Resulphurized austenitic stainless steel with improved machinability, wherein its weight composition is the following:
carbon lower than or equal to 0.15%
silicon lower than or equal to 2%
manganese lower than or equal to 2%
molybdenum lower than or equal to 3%
nickel between 7 and 12%
chromium between 15 and 25%
sulphur between 0.10 and 0.4%
calcium higher than $30\times10^{-4}$%
oxygen higher than or equal to $70\times10^{-4}$%
the ratio of the calcium content and of the oxygen content Ca/O being between 0.3 and 0.6

2. Stainless steel according to claim 1, wherein it contains sulphur in a proportion of between 0.15 and 0.35%.

3. Stainless steel according to claim 1, wherein it contains manganese chromium sulphide (Mn,Cr)S inclusions.

4. Stainless steel according to claim 1, wherein the value of the ratio of the calcium and oxygen element contents is between 0.3 and 0.5.

5. Stainless steel according to claim 1, wherein it contains inclusions of lime silico-aluminate of anorthite and/or pseudowollastonite type.

6. Stainless steel according to claim 3, wherein the inclusions of manganese chromium sulphide are coated with a lime silicoaluminate phase of anorthite and/or pseudowollastonite type to form associated inclusion.

7. Stainless steel according to claim 6, wherein the associated inclusions are produced by the addition of calcium introduced into the melt bath in the form of silicocalcium-cored wire.

8. Stainless steel according to claim 6, wherein the inclusions have a shape factor of between 3 and 6.

* * * * *